United States Patent [19]

Baxter et al.

[11] Patent Number: 4,932,181

[45] Date of Patent: Jun. 12, 1990

[54] BASE ASSEMBLY FOR AN OPEN OFFICE PARTITION PANEL

[75] Inventors: William D. Baxter; Donald H. Kleyn; Bernard R. Lavas; Lowell F. Nelson; Donald E. Thorsen; Lawrence E. Zawlocki, all of Muskegon, Mich.

[73] Assignee: The Shaw-Walker Company, Muskegon, Mich.

[21] Appl. No.: 380,702

[22] Filed: Jul. 13, 1989

Related U.S. Application Data

[63] Continuation of Ser. No. 275,587, Nov. 23, 1988, abandoned.

[51] Int. Cl.[5] ..... E04H 1/00

[52] U.S. Cl. ..... 52/242; 52/729; 439/709

[58] Field of Search ..... 52/220, 221, 729; 174/48, 49

[56] References Cited

U.S. PATENT DOCUMENTS

| | | | |
|---|---|---|---|
| 3,217,452 | 11/1965 | Steele | 52/242 |
| 3,255,563 | 6/1966 | Sauer | 52/242 X |
| 3,830,027 | 8/1974 | Paisley et al. | 52/241 X |
| 3,831,330 | 8/1974 | Tacke et al. . | |
| 4,070,845 | 1/1978 | Cody | 52/729 X |
| 4,133,153 | 1/1979 | Hage | 52/220 |
| 4,255,611 | 3/1981 | Propst et al. . | |
| 4,308,418 | 12/1981 | Van Kuik et al. | 439/209 X |
| 4,406,101 | 9/1983 | Heidmann . | |
| 4,470,232 | 9/1984 | Condevaux | 52/220 |
| 4,593,505 | 6/1986 | Russell | 52/242 X |
| 4,596,098 | 6/1986 | Finkbeiner et al. . | |
| 4,619,095 | 10/1986 | Johnston | 52/241 X |
| 4,713,918 | 12/1987 | Cioffi | 52/221 |
| 4,800,695 | 1/1989 | Meuchetti | 52/221 |

*Primary Examiner*—Carl D. Friedman

*Attorney, Agent, or Firm*—Kinzer, Plyer, Dorn, McEachran & Jambor

[57] ABSTRACT

A base assembly for an open office partition panel. The base assembly is formed in sections, namely, end sections and a center section. An end section is fastened to and supported on each leg. The center section, which fastens to and is supported on the end sections, may be omitted when electrical wiring is not installed in the panel base. Each section is formed of a pair of elongated, channel-shaped housings which are fastened to each other back to back to form a housing section having a center dividing wall and open sides. A snap-in divider separates each channel-shaped housing of the panel base section into upper and lower wire conduits.

8 Claims, 1 Drawing Sheet

BASE ASSEMBLY FOR AN OPEN OFFICE PARTITION PANEL

This is a continuation of application of Ser. No. 275,587, filed on Nov. 23, 1988, now abandoned.

BACKGROUND AND SUMMARY OF THE INVENTION

This invention is concerned with a base assembly for an open office partition system. An object of this invention is a panel base assembly formed in sections in which the center section may be omitted for economy when electrical or communication wiring is not installed in the panel base.

Another object of this invention is a divider for the raceway of a panel base assembly which can be easily installed to divide the raceway into upper and lower wire conduits.

Another object of this invention is a panel base formed of end sections and a center section in which the end sections are directly supported on panel legs and the center section is supported on the end sections.

Other objects of this invention will be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figures 1, 2, 3, 4, 5:
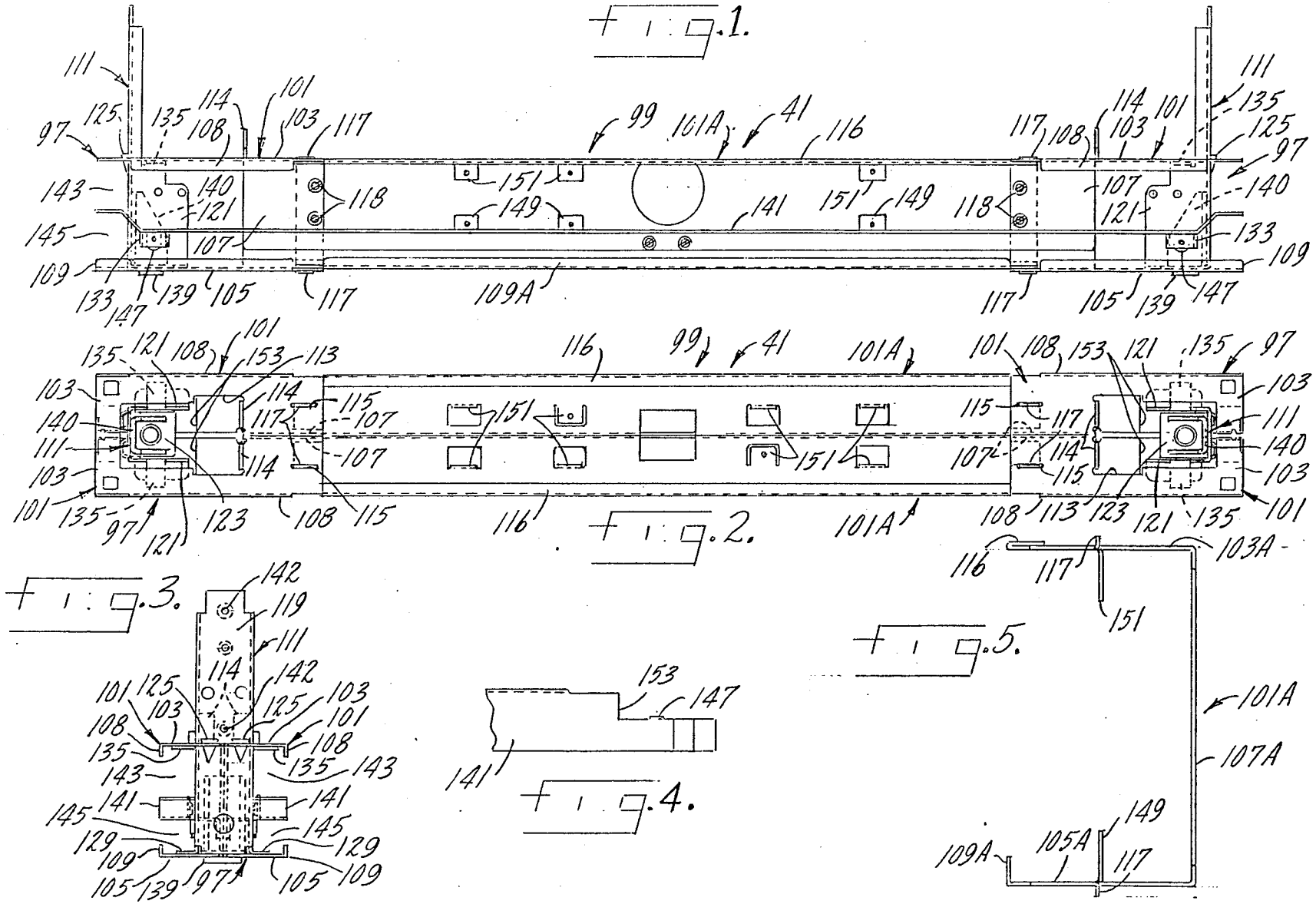
FIG. 1 is a side elevational view of a base assembly for an open office partition panel embodying the novel features of this invention.
FIG. 2 is a top plan view of the base assembly of FIG. 1.
FIG. 3 is an end elevational view of the base assembly of FIG. 1.
FIG. 4 is a partial top plan view of one end of a base panel wire divider partition.
FIG. 5 is an enlarged, end elevational view of a base panel housing center section.

The base assembly 41 of this invention may be used to support panels of the type that are installed in what is called an open office system partition wall or system. These partitions are conventionally freestanding. In some installations, communication and/or power wires are installed in the partition panels; in others, wires are not initially installed, but it is desirable to have the option to install wiring at a later date as conditions change. When used with unwired panels, parts of the base assembly may be omitted to save costs.

The base assembly 41 includes base end sections 97 and a center section 99. The center section may be omitted in base assemblies supporting unwired panels. Each end section 97 includes a pair of elongated, channel-shaped housings 101, each having a top wall 103, a bottom wall 105 and a back wall 107. The channel-shaped housings are fastened together with their back walls abutting to form a base end section 97 having a center dividing wall and open sides. A downwardly-extending lip 108 is formed at the outer edge of each top wall 103 and an upwardly-extending lip 109 is formed at the outer edge of each bottom wall 105. As can be seen most clearly in FIGS. 1 and 2 of the drawings, the back walls 107 do not extend the full length of the base end section but terminate short of the outside longitudinal end so as not to interfere with the installation of a leg 111 near the outside longitudinal end of the base end section 97. The leg rests on the bottom walls 105 of the housings 101 and extends through an opening 113 formed in the top walls 103 of the housings 101. The opening 113 is elongated longitudinally inwardly of the leg 111 terminating at the outer end of the back wall 107 and is also extended longitudinally outwardly slightly beyond the leg. This opening provides clearance for the passage of wires from the base assembly 41 into vertical end channels of a supported panel and also permits the panel connector support rails to be contacted by the legs 111. Upstanding tabs 114 are formed in the top walls 103 at the inside end of the opening 113. These tabs engage walls of bottom channels of a supported panel to stabilize the panel. An elongated slot 115 is formed in the top wall 103 and bottom wall 105 of each housing 101 adjacent the inside end of each end section 97 to receive fastening tabs to be described later.

The base center section 99 is constructed in a manner similar to an end section 97, but is much longer. It includes a pair of elongated, channel-shaped housings 101A, each having a top wall 103A, a bottom wall 105A and a back wall 107A. The channel-shaped housings are fastened together with their back walls abutting to form a base center section 99. A strengthening fold 116 is formed along the outer edge of each top wall 103A and an upwardly-extending lip 109A is formed at the outer edge of each bottom wall 105A. Upwardly and downwardly-extending tabs 117 are formed in each top wall 103A and bottom wall 105A to be received in the slots 115 formed in the end sections 97 to connect the center section 99 to the end sections 97 of the base assembly in a snap-together arrangement when the center section is telescoped into the end sections. The sections are also held together by one or more screws 118 which extend through openings formed in the end and center sections, as best seen in FIG. 1 of the drawings. However, the primary function of the screw or screws is electrical grounding, not fastening, since the tabs and slots are adequate to connect the center section to the end sections.

Each leg 111 is formed of heavy gauge steel having a generally U-shaped, horizontal cross-section, as can be seen most clearly in FIG. 2 of the drawings. Each leg includes an end wall 119, shorter side walls 121 and an essentially open, opposite end wall 123. The end wall 119 faces the outer end of the base assembly 41, while the open end wall 123 faces the interior of the base assembly. The end wall 119 is dimensioned so that it extends above the base assembly and into end channels of a supported panel. A pair of triangular-shaped, stamped ledges 125 are formed on the end wall 119 to engage and support a structural member of a panel. The ledges extend through the opening 113 formed in the top walls 103. Feet 129 are formed at the bottom of each leg 111 to rest on and are welded to the bottom walls 105 of the base assembly end section 97, as seen in FIGS. 1 and 3 of the drawings. Outwardly-extending loops 133 are formed in the side walls 121 of the leg. A pair of brackets 135 are formed at the top of the side walls 121 to engage the top wall 103 of the end section 97 of the base assembly 41, as seen in FIGS. 2 and 3 of the drawings. As can also be seen in the drawings, the inner end 123 and top of each leg 111 are open and channel shaped to permit the pull-through of wires from the base assembly into the supported panel.

A weld nut 139, shown in FIGS. 1 and 3 of the drawings, is provided in each leg for mounting a glide to raise and lower the leg for leveling purposes. Each glide (not shown) includes a threaded rod which threads into the weld nut 139. A steel reinforcing member 140 having a wall of U-shaped, horizontal cross-section and a base fits inside each leg 111 and is welded to the end wall 119 of the leg, the bottom walls 105 of the housings 101 and the weld nut 139 to stabilize the threaded rod of the glide. Threaded openings 142, shown in FIG. 3, receive fasteners to attach the end wall 119 of the leg to a structural member of a panel.

When wiring is not to be installed in a panel, it is not necessary to provide a center section 99 in the base assembly 41. In such installations, only base end sections 97 are installed. The end sections provide mounting means at each end of the panel for base panel side covers (not shown) which extend the full length of the panel. The space between base end sections is left unused.

A horizontal divider partition 141, shown in FIGS. 1 through 4 of the drawings, may be provided for each side of the base assembly 41 formed of end sections 101 and center section 101A to divide the housing into upper and lower raceways for wires. Usually the upper raceway 143 is used for power wiring and the bottom raceway 145 is used for communication wiring. The divider partition 141 is equipped with down-turned tabs 147 at its ends, which tabs fit into the loops 133 formed on the legs 111 to support the partition. Upwardly-extending tabs 149 are also formed on the divider partition to cooperate with downwardly-extending tabs 151 formed in the top wall 103A of the center section 99 of the channel-shaped housing 101. The downwardly and upwardly-extending tabs are furnished with screw holes so that power receptacles and wiring can be fastened to the tabs. Each partition 141 is notched at 153 adjacent the legs 111 to provide access for wires between the upper and lower raceways 143 and 145, respectively. A conventional side cover, not shown, encloses the outer walls of the channel-shaped housings 101, and these covers are held in place by horizontally-extending spring clips (also not shown) which must be depressed with a screwdriver to release the side covers.

We claim:

1. A base assembly for an open office partition panel, including:

a base housing formed of a pair of end sections connected to a center section, each section including a pair of elongated, channel-shaped housings, each housing having a top wall, a bottom wall and a back wall, the channel-shaped housings being fastened t each other with their back walls abutting to form a base housing section having a center dividing wall and open sides, the top, bottom and center dividing walls of each end section overlapping the top, bottom and center dividing walls of the center section, fastening means to removably connect the end sections to the center section at the overlap of the sections, and a supporting leg positioned in each end section.

2. The base assembly of claim 1 in which said fastening means to removably connect the end sections to the center section at the overlap of the sections include slots on one section and interfitting tabs on the other section which are received in said slots.

3. A base assembly for an open office system partition panel, including:

a base housing formed of a pair of end sections connected to a center section, each section including a pair of elongated, channel-shaped housings, each housing having a top wall, a bottom wall and a back wall, the channel-shaped housings being fastened to each other with their back walls abutting to form a base housing section having a center dividing wall and open sides, the top, bottom and center dividing walls of each end section overlapping the top, bottom and center dividing walls of the center section, and terminating short of the opposite longitudinal end of its section, fastening means to removably connect the end sections to the center section at the overlap of the sections, a leg positioned in each end section with each leg having spaced apart side walls with an outwardly-extending loop formed in each side wall, and a horizontally-extending divider partition for separating each section of each channel-shaped housing into an upper power wire raceway and a lower communications wire raceway, said divider partition having an integrally formed, downwardly-turned tab at each end, which tabs are seated in the loop of the legs to position and support the partition in the base housing.

4. The base assembly of claim 1 having an elongated opening formed in the top wall of each end section around its supporting leg, with each of said openings extending longitudinally inwardly of its supporting leg to permit the passage of wires out of the base housing and upwardly, and upstanding tabs formed at the edge of each of said elongated openings longitudinally inwardly of each supporting leg, to engage and stabilize a panel supported on said base assembly.

5. The base assembly of claim 4 in which said divider partition is notched at each end adjacent said legs to provide an opening for access to the lower communications wire raceway from the top of the partition panel.

6. The base assembly of claim 4 in which at least one integrally-formed, upturned tab is provided inwardly of the ends of the divider partition to project into the upper power raceway to receive and mount an electrical receptacle.

7. A base assembly for an open office partition panel, including:

a base housing formed of a pair of end sections connected to the opposite ends of a center section, center, top and bottom walls formed in each of the end and center sections, with said walls overlapping one another where the end and center sections are connected to one another, fastening means to removably connect the end sections to the center section at each overlap of the end and center sections, and a supporting leg formed independently of the center, top and bottom walls of each end section positioned at each end section.

8. The base assembly of claim 7 further characterized in that the fastening means to removably connect the end sections to the center section at each overlap of the end and center sections are located in the top and bottom walls of said end and center sections.

* * * * *